United States Patent [19]

Ifield

[11] 4,129,063

[45] Dec. 12, 1978

[54] BENT AXIS PUMPS AND MOTORS

[75] Inventor: Richard J. Ifield, Beecroft, Australia

[73] Assignee: Ifield Engineering Pty. Limited, Dural, Australia

[21] Appl. No.: 724,100

[22] Filed: Sep. 17, 1976

[30] Foreign Application Priority Data

Oct. 1, 1975 [AU] Australia ..... PC3394

[51] Int. Cl.[2] ..... F01B 13/04

[52] U.S. Cl. ..... 91/506

[58] Field of Search ..... 91/504–507; 92/12.2

[56] References Cited

U.S. PATENT DOCUMENTS

| | | | |
|---|---|---|---|
| 2,967,395 | 1/1961 | Foerster | 92/12.1 |
| 3,063,381 | 11/1962 | Bodzich | 91/506 |
| 3,136,264 | 6/1964 | Wahlmark | 91/506 |
| 3,175,511 | 3/1965 | Ifield | 91/505 |
| 3,943,828 | 3/1976 | Wagenseil | 91/505 |

FOREIGN PATENT DOCUMENTS

| | | | |
|---|---|---|---|
| 204712 | 8/1954 | Australia | 91/505 |
| 630649 | 11/1971 | Canada | 91/506 |
| 2117634 | 10/1972 | Fed. Rep. of Germany | 91/504 |
| 1359231 | 3/1964 | France | 91/506 |
| 973707 | 10/1964 | United Kingdom | 91/507 |
| 994666 | 6/1965 | United Kingdom | 91/506 |
| 1326921 | 8/1973 | United Kingdom | 91/505 |

*Primary Examiner*—William L. Freeh
*Attorney, Agent, or Firm*—Bard & Groves

[57] ABSTRACT

A bent axis pump having a port in the housing thereof which port is movable to vary the displacement of the pump and including leak-proof transfer sleeves extending between the port and the housing to effect flow of fluid between the pump housing and the port.

7 Claims, 3 Drawing Figures

BENT AXIS PUMPS AND MOTORS

This invention relates to variable displacement pumps and motors of the "bent axis" type in which a cylinder block defining a plurality of spaced apart cylinders extending in the axial direction of the block, is driven through a universal joint from a driving disc, to which the pistons are attached by ball and socket joints, so that on rotation of the block the pistons reciprocate within the cylinders through a stroke which is a function of the drive angle, namely the angle of the cylinder block axis to the drive shaft axis, that is to say as the drive angle increases the cylinder stroke increases.

The rotating cylinder block includes a flat ported face which is held in close contact with a flat ported surface of a non-rotating port block defining fluid inlet and outlet ducts.

In pumps or motors of this type in order to vary the drive angle and hence the piston stroke, the port block must be pivoted within the housing and it is necessary to provide sealed transfer passages between the ducts in the port block and corresponding ports in the pump or motor housing suitable for establishing pipe connections therewith.

For descriptive convenience the further description primarily makes reference to pumps only, it being well known that in general any pump of the bent axis type may function also as a motor when fed with pressurised fluid.

Hitherto the means for providing transfer passages from the pivotable port block to the stationary housing have been costly and complex: in one type of pump, the transfer passages are arranged in a tortuous path through a yoke mounting; in another, ports are provided in the curved, complementary bearing surfaces of the port block and housing, thereby requiring complex sealing arrangements.

The resultant of the mean axial thrusts from the pumping cylinders on the cylinder block falls on a line extending through the centre of the mid-stroke piston, but during rotation there are fluctuations in the number of cylinders under pressure and the resultant thrust fluctuates each side of the mid thrust position on that line. This results in fluctuating tilting moments of considerably magnitude acting on the port block and the resulting small movements of the port block are the cause of much of the objectionable high frequency noises associated with bent axis pumps and motors.

An object of the present invention is to provide improved transfer passages from the port block to the housing which do not require complex seals or labyrinthine passages and which, in preferred forms, permit sufficient frictional force to be applied to the port block to resist port block oscillation.

According to the invention there is provided a bent axis pump or motor having a port block which is movable thereby to vary the pump or motor displacement characterised in that fluid flow from the housing to and from the operating cylinders through said port block is effected by means of transfer sleeves leak-proofedly extending between said port block and said housing.

Preferably, the port block is provided with two transfer sleeves which are positioned such that, in combination with servo forces, couples imposed upon the port block are avoided or minimised.

The port block may be provided with a servo piston and cylinder arrangement located between the two transfer sleeves. Preferably, however, the port block contains only the transfer sleeves with the servo mechanism being located separately, thereby permitting larger transfer passages to be used with a corresponding increase in efficiency.

A preferred embodiment of the invention will now be described, by way of example only, with reference to the accompanying drawings in which.

Figure 1:
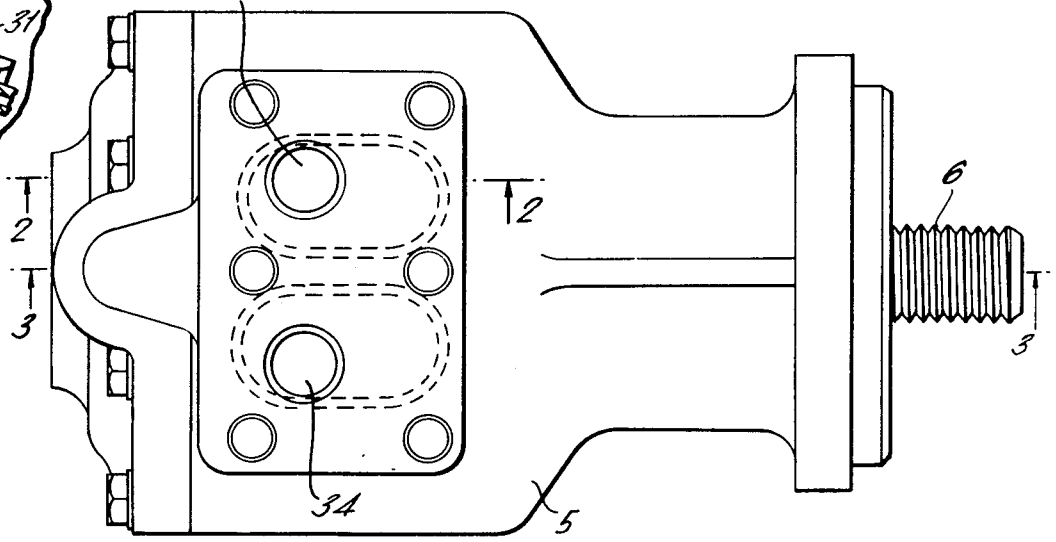
FIG. 1 is a plan view of a bent axis pump according to the invention.

Referring to the drawings, the pump 4 comprises a housing 5 which supports an input shaft 6 on bearing 7 and 8. Connected to the shaft 6 is a driving disc 9 to which a plurality of pistons 10 are attached by ball and socket joints 11. The driving disc 9 may be supported by any suitable means, such as that described in U.S. Pat. No. 3,791,703. A cylinder block 12 is also driven by the shaft 6 through a universal joint 13 such that on rotation of the cylinder block 12, the pistons 10 reciprocate within cylinders 14. The cylinder block 12 includes a flat, ported face 15 which is held in close contact with the adjacent ported surface 16 of a non-rotating port block 17.

Figure 2:
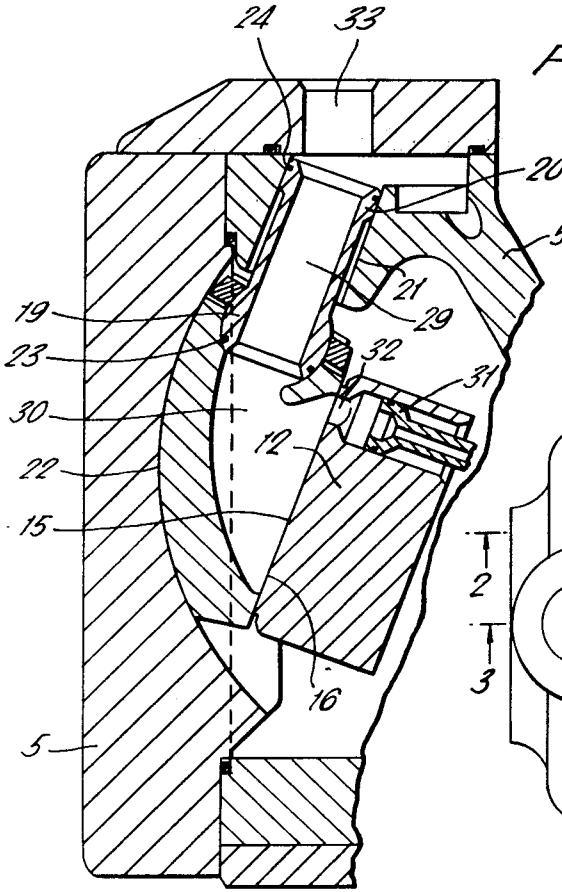
FIG. 2 is an incomplete sectional view taken on line 2—2 of FIG. 1 illustrating one of two transfer sleeves.
Figure 3:
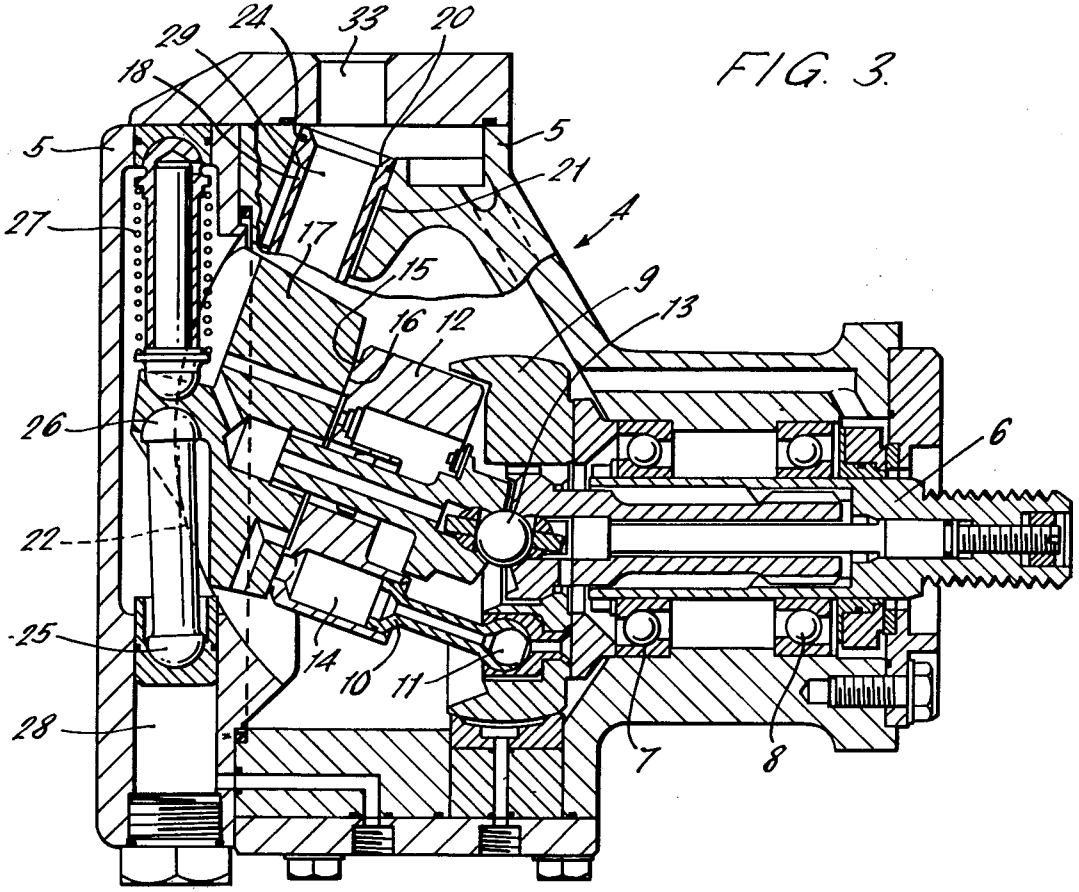
FIG. 3 is a compound sectional view taken partly on line 2—2 but predominantly on line 3—3 of FIG. 1.

Fluid flow to and from the port block 17 and the housing 5 is effected through two inlet and outlet transfer sleeves respectively, of which only one is illustrated in FIGS. 2 and 3. One end of this transfer sleeve 18 is attached to the port block by a ball and socket joint 19, while the other end 20 slides in a cylinder 21 as the port block is pivoted within the housing 5 along a curved sliding surface 22. It is preferable from efficiency considerations to pivot the port block 17 about an axis intersecting the axis of the piston in the top dead centre position at or near the ball end centre of that piston, so that the unswept volume within the cylinders remains substantially constant at its minimum value for all piston strokes. The pump displacement may then be variable from zero to maximum in one direction only but this meets most requirements when used in combination with main flow reversing valves. If desired, the attachment mode of the transfer sleeves may be reversed, with the ball and socket joint being located in the housing and the cylinder 21 formed in the port block, or, alternatively, both ends of the sleeve may slide in cylinders formed in the port block and housing respectively. In either case the invention permits the use of relatively simple seals 23 and 24 in place of the complex seals which were required when fluid was ducted through ports in the curved surface 22.

Movement of the port block is effected by a servo piston 25 which acts upon a ball joint 26 formed on an extension of the port block 17 which passes through a slot in the curved surface 22 of housing 5. The servo piston 25 is biased by return spring 27 such that the port block assumes a position of minimum pump displacement in the absence of fluid pressure in servo cylinder 28. Fluid pressure for the servo piston may be provided from any suitable source and controlled by conventional means not relevant to the present invention.

Each transfer sleeve 18 defines a passageway 29 which communicates through passage 30 in the port block with a part-annular or kidney-shaped port in the flat, ported face 16 of the port block which opposes the corresponding face 15 of the cylinder block 12. In the position shown in FIG. 2, the piston 31 is nearing the end of its stroke and exhausting fluid through port 32, into passage 30 and out through passageway 29 to an outlet port 33 formed in the pump housing 5. The second or inlet transfer sleeve (not shown) is identical in form and operation with the exhaust sleeve 18 but is spaced laterally therefrom and accepts fluid through inlet port 34 as shown in FIG. 1. From port 34, the incoming fluid passes through the inlet sleeve and into a passage within the port block spaced from and symmetrically identical with passage 30 from which it flows to the symmetrically identical inlet port in the port block face 16. The arrangement of these ports is well known and need not be further described. The ducting of fluid to and from the pump cylinders 14 through the transfer sleeves 18 provides a relatively free passage for the fluid which permits greater pumping speeds and efficiencies than are possible in cases where the fluid is ducted through tortuous paths in a yoke mounting arrangement. Moreover, the sealing arrangements are less complex than those required for mating ports in the curved surfaces 21. Furthermore, the arrangement shown results in the application to the port block 17 of a frictional force over surface 22 which is sufficient to prevent oscillations of the port block induced by the changing pressure forces imposed through the action of the rotating cylinder block. This frictional force is supplemented by the usual spring loading of the cylinder block 12 against the port block but is still capable of being swamped by the thrust of the servo piston 25 or return spring 27 as the case may be, to effect required changes in pump displacement. For further improvement, the transfer sleeves 18 are preferably positioned in conjunction with the servo piston such that couples imposed upon the port block are reduced or substantially eliminated.

Although the invention has been described with reference to a specific example, it will be appreciated by those skilled in the art that the invention can be embodied in many other forms without departing from the scope of the inventive concept.

The claims defining the invention are as follows:

1. A bent axis pump or motor, comprising:

a stationary housing means defining a fluid inlet and a fluid outlet region, said housing including an arcuate surface therein, a port block arcuately movable along said surface within said housing to vary the pump or motor displacement and having a plurality of fluid receiving chambers, a cylinder block housing a plurality of operating cylinders and rotating about a central axis and rotating relative to said port block to present one of said operating cylinders in a fluid intake position to one of said plurality of fluid receiving chambers and to subsequently present said one of said operating cylinders in a fluid discharge position to another of said plurality of fluid receiving chambers, and a fluid transfer sleeve serving as an inlet and a fluid transfer sleeve serving as an outlet each slidably mounted within said housing and sealingly extending between each of said fluid receiving chambers and one of said regions, said transfer sleeves extending generally perpindicular to the rotational axis and being located on the same side of the port block, whereby couples imposed upon said port block in operation are minimized.

2. A bent axis pump or motor according to claim 1, wherein said transfer sleeves have a ball-shaped configuration at one end and a cylindrical configuration at the other end.

3. A bent axis pump or motor according to claim 2, wherein said ball-shaped configuration is received by a socket joint located in said port block and said cylindrical configuration is received by said housing.

4. A bent axis pump or motor according to claim 1, further including at least one servo piston slidably mounted in said housing between two of said transfer sleeves.

5. A bent axis pump or motor according to claim 4, further including means for biasing said port block towards a position of minimum pump or motor displacement in the absence of an actuating force on said servo piston.

6. A bent axis pump or motor according to claim 4, wherein said transfer sleeves have a ball-shaped configuration at one end and a cylindrical configuration at the other end.

7. A bent axis pump or motor according to claim 6, wherein said ball-shaped configuration is received by a socket joint located in said port block and said cylindrical configuration is received by said housing.

* * * * *